US005284610A

United States Patent [19]

Tai

[11] Patent Number: 5,284,610

[45] Date of Patent: Feb. 8, 1994

[54] HIGH MOLECULAR ABSORBENT SHEET MANUFACTURING PROCESS AND THE RELATED EQUIPMENT

[75] Inventor: Hua-Hsi Tai, Tainan, Taiwan

[73] Assignee: Kang Na Hsiung Enterprise Co., Ltd., Tainan, Taiwan

[21] Appl. No.: 15,222

[22] Filed: Feb. 9, 1993

[51] Int. Cl.[5] ..... D04H 1/72

[52] U.S. Cl. ..... 264/112; 264/119; 264/121; 264/122; 425/81.1; 425/83.1

[58] Field of Search ..... 264/112, 119, 121, 122, 264/128; 425/81.1, 83.1

[56] References Cited

U.S. PATENT DOCUMENTS

| | | | |
|---|---|---|---|
| 4,295,907 | 10/1981 | Cordts et al. | 156/246 |
| 4,352,649 | 10/1982 | Jacobsen et al. | 425/83.1 |
| 4,640,810 | 2/1987 | Laursen et al. | 264/518 |
| 4,655,861 | 4/1987 | Kiss | 156/62.2 |
| 5,128,082 | 7/1992 | Makoui | 264/112 |
| 5,137,668 | 8/1992 | Lamb, Sr. | 264/112 |

*Primary Examiner*—Mary Lynn Theisen

[57] ABSTRACT

The invention relates to a high molecular absorbent sheet manufacturing process and the related equipment for employing such manufacturing process. The process includes a step of sending a paper pulp and a high molecular absorbent compound to a trough for mixing by wired cylinders and spreading over a conveyer system, a step of drying the mixture carried on the conveyer system, and a step of squeezing the dried mixture into a roll of high molecular absorbent sheet through two matched hot impression cylinders. A sheet of thermoplastic mesh fabric may be respectively covered on the mixture on two opposite sides before the process of drying.

10 Claims, 3 Drawing Sheets

HIGH MOLECULAR ABSORBENT SHEET MANUFACTURING PROCESS AND THE RELATED EQUIPMENT

BACKGROUND OF THE INVENTION

The present invention relates to a high molecular absorbent sheet manufacturing process to produce a roll of high molecular absorbent sheet from a mixture containing a high molecular compound and a paper pulp. The invention also relates to an equipment for employing the high molecular absorbent sheet manufacturing process.

Various absorbent sheet materials are known and widely used for different purposes. The equipment for making an ordinary absorbent sheet material according to the prior art manufacturing methods are commonly expensive and difficult to operate.

SUMMARY OF THE INVENTION

The present invention provides a high molecular absorbent sheet material manufacturing process for making a high molecular absorbent sheet material of high absorbent power through an inexpensive manufacturing equipment. A paper pulp and a high molecular absorbent compound are selected and mixed by wired cylinders in a trough and then uniformly spread over a sheet of thermoplastic mesh fabric carried on a conveyer system, then dried through a dryer, and then squeezed into a roll of high molecular absorbent sheet through two matched hot impression cylinders. A second sheet of thermoplastic mesh fabric may be covered on the mixture carried at the top before it is delivered through the drying. The mixture of the paper pulp and high molecular absorbent compound may be directly spread over the conveyer system and coated with a top layer of adhesive agent, then dried through the dryer, and then squeezed into a roll of high molecular absorbent sheet through the hot impression cylinders.

DETAILED DESCRIPTION OF THE PREFERRED EMBODIMENTS

Figure 1:
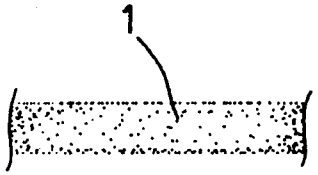
FIG. 1 is a cross section of a high molecular absorbent sheet material according to the present invention.

Referring to FIG. 1, therein illustrates is a cross section of a high molecular absorbent sheet material made according to the present invention. The high molecular absorbent sheet material is generally comprised of an absorbent sheet body 1 made from a mixture containing a paper pulp and a high molecular absorbent compound. The proportion of the paper pulp to the high molecular absorbent compound may be determined according to different requirements. The high molecular absorbent compound can be a water absorbing acrylic powder or any suitable high molecular absorbent starch. The water absorbing characteristics of the high molecular absorbent compound is not within the scope of the present invention, and therefore no further detailed description is needed.

Figure 3:
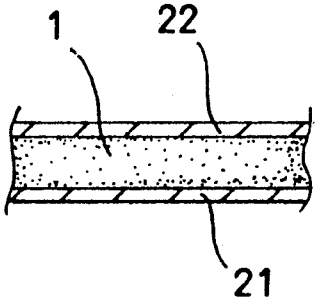
FIG. 3 is a cross section showing the high molecular absorbent sheet material coated with a layer of thermoplastic mesh fabric on both sides.
Figure 2:
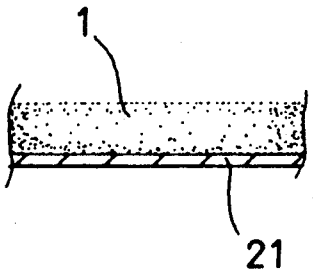
FIG. 2 is a cross section showing the high molecular absorbent sheet material coated with a layer of thermoplastic mesh fabric on the bottom.

Referring to FIGS. 2 and 3, a thermoplastic mesh fabric 21 may be covered on the bottom surface of the absorbent sheet body 1 to improve its tensile strength (see FIG. 2); the two opposite large sides of the absorbent sheet body 1 may be covered with a respective thermoplastic mesh fabric 21 or 22 (see FIG. 3).

Figure 4:
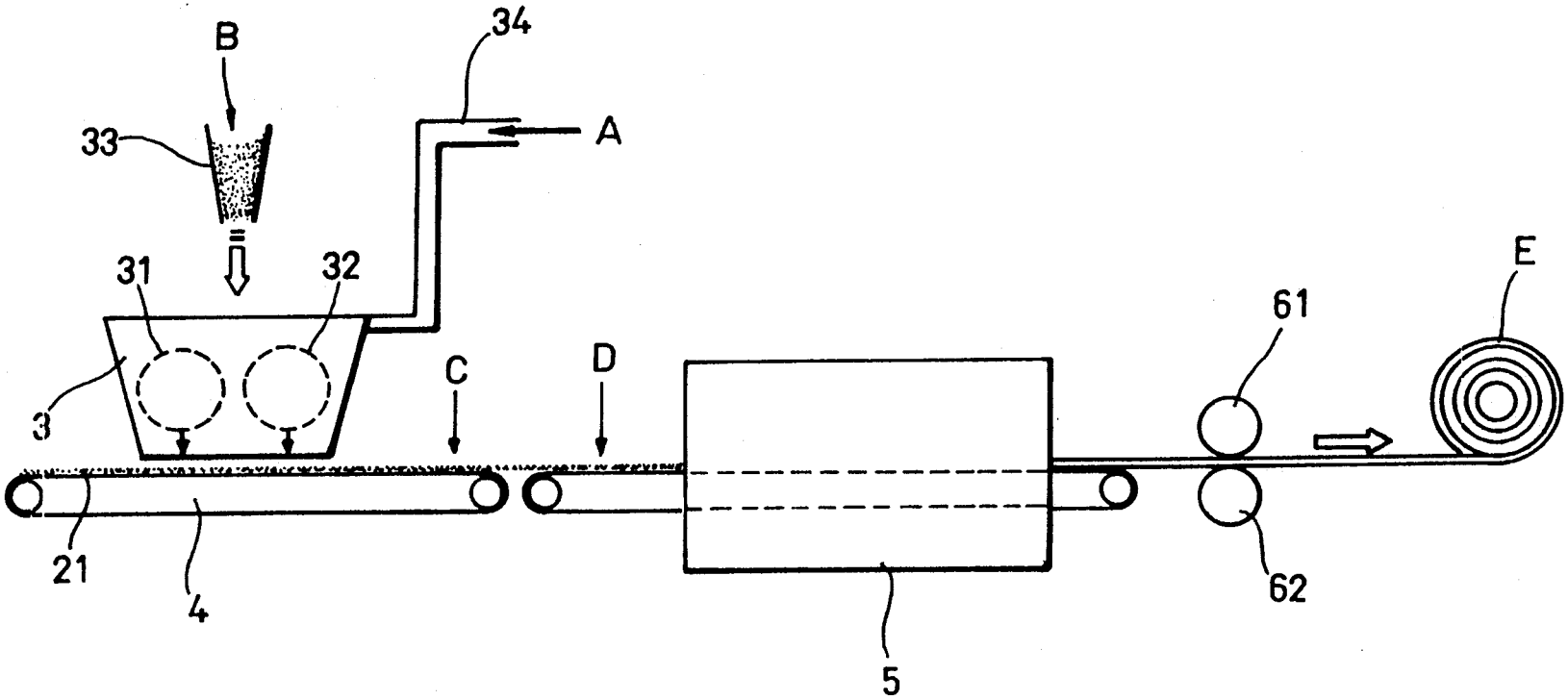
FIG. 4 is a production flow chart according to the present invention.

Referring to FIG. 4, therein illustrated is a high molecular absorbent sheet material production flow chart according to the present invention. The hardware equipment for making a high molecular absorbent sheet material includes a conveyer system 4, a trough 3 disposed above the conveyer system 4, a hopper 33 disposed above the trough 3, a feed pipe 34 connected to the trough 3, two wired cylinders 31,32 revolvably fastened inside the trough 3, a dryer 5, and two hot impression cylinders 61,62. The conveyer system 4 is to carry a sheet of thermoplastic mesh fabric 21. A paper pulp A is continuously delivered to the trough 3 through the feed pipe 34 and mixed by the wired cylinders 31,32 with a high molecular absorbent compound B delivered from the hopper 33. The wired cylinders 31,32 are rotated by a conventional power unit, for example: a motor drive, to uniformly spread the paper pulp A and the high molecular absorbent compound B over the sheet of thermoplastic mesh fabric 21 passing below. Therefore, the paper pulp A and the high molecular absorbent compound B are uniformly mixed over the sheet of thermoplastic mesh fabric 21 carried on the conveyer system 4 and then dried by the dryer 5. After the process of drying through the dryer 5, the mixture coated sheet of thermoplastic mesh fabric 21 is transferred through the hot impression cylinders 61,62 and squeezed into a roll of high molecular absorbent sheet E. The roll of high molecular absorbent sheet E can then be cut into pieces according to the desired lengths and patterns. For making a roll of high molecular absorbent sheet having both sides respectively covered with a thermoplastic mesh fabric, a second sheet of thermoplastic mesh fabric should be covered on the mixture coated sheet of thermoplastic mesh fabric 21 at the top during the aforesaid production procedure at position C (behind the trough 3). For making a roll of high molecular absorbent sheet without thermoplastic mesh fabric covering, an adhesive agent should be applied to the mixture of the paper pulp A and the high molecular absorbent compound B during the production procedure at position D before passing through the dryer 5.

Figure 5:
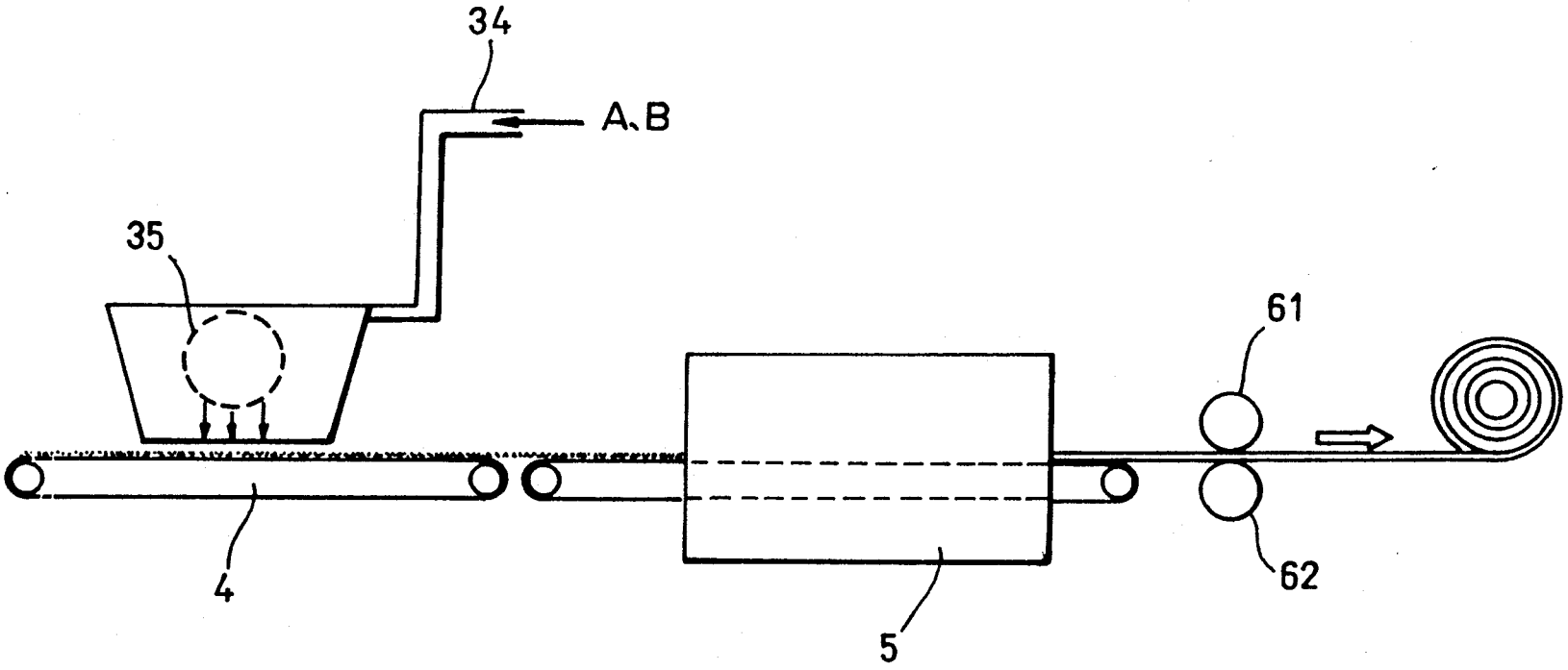
FIG. 5 is an alternate form of the production flow chart.

Referring to FIG. 5, therein illustrated is an alternate form of the hardware arrangement according to the present invention. In this alternate arrangement, the selected paper pulp A and high molecular absorbent compound B are simultaneously delivered to the trough 3 through the feed pipe 34, and a single wired cylinder 35 is fastened inside the trough 3 to mix the paper pulp A and the high molecular absorbent compound B and spread the mixture over the conveyer system 4 or the sheet of thermoplastic mesh fabric carried on the conveyer system 4.

What is claimed is:

1. A high molecular absorbent sheet material manufacturing process comprising steps of:

a) feeding a paper pulp to a mixing trough having two wired cylinders through a feed pipe;

b) feeding a high molecular absorbent compound to said mixing trough through a hopper;

c) turning said wired cylinders to mix the paper pulp and the high molecular absorbent compound into a mixture and spread the mixture over a conveyer system;

d) carrying the mixture obtained from said step c) to a dryer for drying; and e) transferring the dried mixture obtained from said step d) through the pitch between two matched hot impression cylinders for squeezing into a roll of high molecular absorbent sheet.

2. The manufacturing process of claim 1, wherein the mixture obtained from said step c) is coated with a layer of adhesive agent before the process of drying.

3. The manufacturing process of claim 1, wherein the mixture obtained from said step c) is covered with a sheet of thermoplastic mesh fabric on the top before the process of drying.

4. A high molecular absorbent sheet material manufacturing process comprising steps of:

a) feeding a paper pulp and a high molecular absorbent compound to a mixing trough having a wired cylinder through a feed pipe;

b) turning said wired cylinder to mix the paper pulp and the high molecular absorbent compound into a mixture and spread the mixture over a conveyer system;

c) carrying the mixture obtained from said step b) to a dryer for drying; and d) transferring the dried mixture obtained from said step c) through the pitch between two hot impression cylinders for squeezing into a roll of high molecular absorbent sheet.

5. A high molecular absorbent sheet material manufacturing process comprising steps of:

a) feeding a paper pulp to a mixing trough having two wired cylinders through a feed pipe;

b) feeding a high molecular absorbent compound to said mixing trough through a hopper;

c) turning said wired cylinders to mix the paper pulp and the high molecular absorbent compound into a mixture and spread the mixture over a sheet of thermoplastic mesh fabric carried on a conveyer system;

d) carrying the mixture covered sheet of thermoplastic mesh fabric obtained from said step c) to a dryer for drying; and e) transferring the dried, mixture covered sheet of thermoplastic mesh fabric obtained from said step d) through the pitch between two matched impression cylinders for squeezing into a roll of high molecular absorbent sheet.

6. The manufacturing process of claim 5 wherein the mixture covered sheet of thermoplastic mesh fabric obtained from said step c) is coated with a layer of adhesive agent before the process of drying.

7. The manufacturing process of claim 5, wherein the mixture covered sheet of thermoplastic mesh fabric obtained from said step c) is covered with a sheet of thermoplastic mesh fabric on the top before the process of drying.

8. The manufacturing process of claim 5 wherein the pitch between said two matched hot impression cylinders can be adjusted to change the density of the roll of high molecular absorbent sheet.

9. An equipment for a high molecular absorbent sheet material manufacturing process comprising a conveyer system, two wired cylinders fastened in a trough above said conveyer system and turned by a power unit, a feed pipe for delivering a paper pulp to said wired cylinders, a hopper for carrying a high molecular absorbent compound to said wired cylinders, a dryer for drying the mixture mixed and spread over said conveyer system by said wired cylinders, and two hot impression cylinders for squeezing the dried mixture delivered from said dryer into a roll of high molecular absorbent sheet.

10. The equipment of claim 9 wherein the pitch between said two hot impression cylinders can be adjusted so as to change the density of the roll of high molecular absorbent sheet.

* * * * *